United States Patent [19]

Gibson et al.

[11] 4,021,900

[45] May 10, 1977

[54] MILL ROLL MOUNTING

[75] Inventors: Keith C. Gibson, Kingston; John M. Hookins, Bromley; Roy R. Oxlade, London, all of England

[73] Assignee: British Steel Corporation, London, England

[22] Filed: Dec. 18, 1975

[21] Appl. No.: 641,951

[30] Foreign Application Priority Data

Jan. 17, 1975 United Kingdom ..... 2127/75

[52] U.S. Cl. ..... 29/117; 29/129; 72/238

[51] Int. Cl.[2] ..... B21B 31/08

[58] Field of Search ..... 72/237, 238, 247; 29/129, 117

[56] References Cited

UNITED STATES PATENTS

| | | | |
|---|---|---|---|
| 1,430,418 | 9/1922 | Vedder | 29/117 |
| 2,638,722 | 5/1953 | Rimmel | 29/117 X |
| 2,950,934 | 8/1960 | Uebing | 72/224 X |
| 3,023,699 | 3/1962 | MacArthur | 29/129 X |
| 3,611,531 | 10/1971 | Townsend et al. | 29/129 |
| 3,793,869 | 2/1974 | Hufnagl | 72/236 |
| 3,866,283 | 2/1975 | Gould | 72/238 X |

*Primary Examiner*—Milton S. Mehr
*Attorney, Agent, or Firm*—Bacon & Thomas

[57] ABSTRACT

A work roll assembly for a cantilever-type rolling mill includes a work roll shaft which is drivable from one end and which has a locating spigot extending axially outward of the shaft at its other end. The annular work roll to be mounted to said shaft has an axial recess to receive the spigot. A hydraulic device is provided to urge the roll into engagement with the shaft so as to axially locate the work roll. The locating spigot is expandable in a radial direction to engage the cylindrical inner surface of the work roll recess so as to radially locate the roll to the shaft.

8 Claims, 3 Drawing Figures

Figure 1:
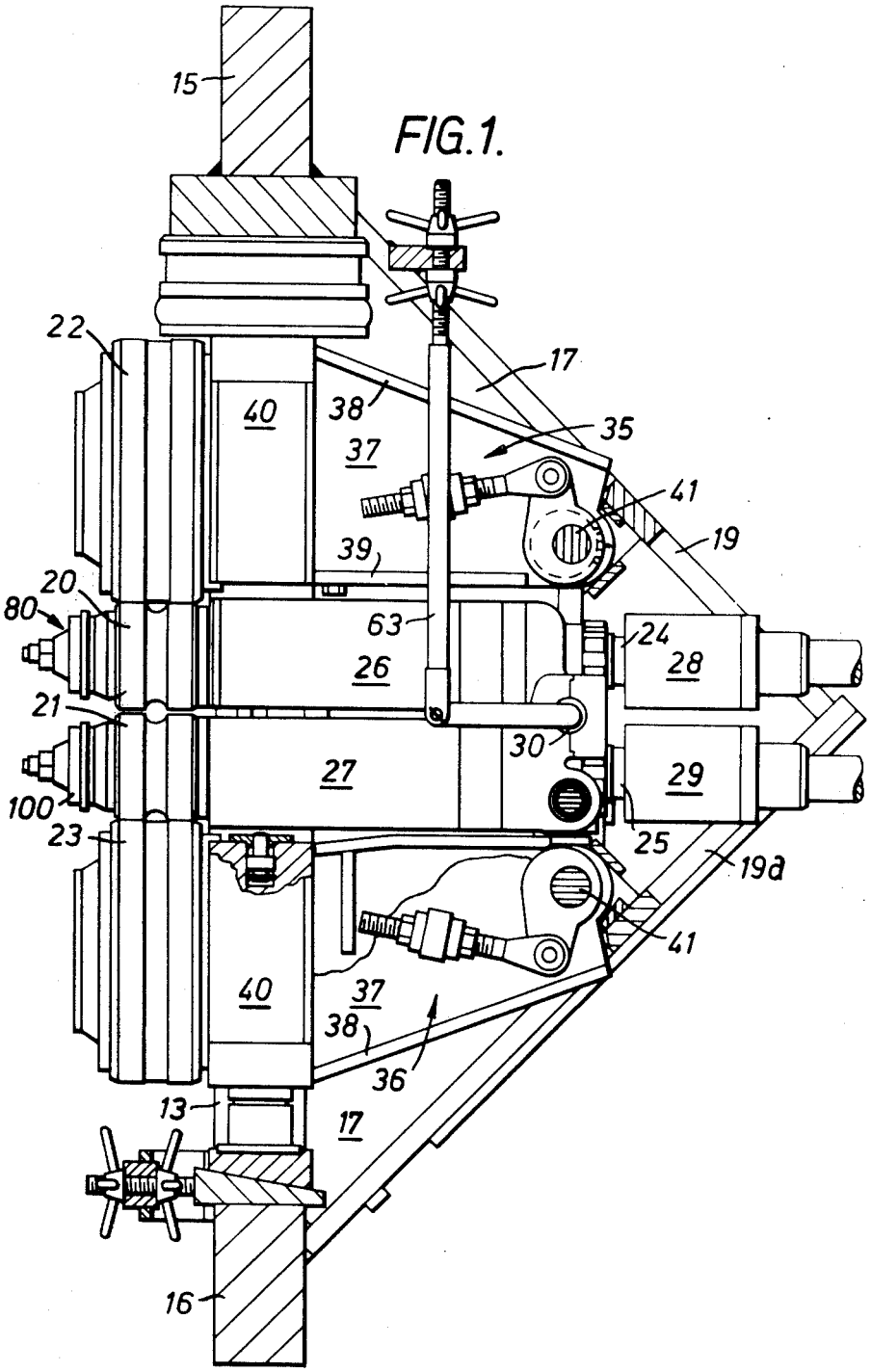

15
22
17
40
38
37
35
41
19
39
20
80
63
24
28
26
21
30
27
29
100
23
25
19a
41
40
37
38
36
13
17
16

MILL ROLL MOUNTING

This invention relates to the mounting of a removable rolling mill roll to a shaft of the rolling mill arranged to carry that roll.

British Patent specification No. 1,240,656 describes a form of mounting for a removable work roll in which the work roll is located axially and radially to a drive shaft by means of an annular seat on said shaft and a cylindrical locating spigot which fits into a cylindrical axial recess in the work roll. We have found that the above-described arrangement has certain disadvantages in connection with the accurate radial location of the work roll. In particular it is necessary for there to be a clearance between the outer cylindrical surface of the spigot and the cylindrical mating surface of the recess to enable the work roll to be fitted onto the shaft and withdrawn from the shaft without undue stress being applied to the system. Because the mounting is normally carried out with the shaft in a horizontal position or inclined at an acute angle to the horizontal, the spigot and recess tend to fit together so that they are in mutual contact on the upper side of the spigot and there is a small clearance on the lower side of the spigot. This means that when the shaft is rotated in normal use, the work roll is eccentrically mounted to the shaft and therefore causes variations in the workpiece dimensions in a cyclic manner for every revolution of the roll. Whilst the amount of eccentricity may be small in relation to the diameter of the work roll, it can be significant in relation to the diameter of a workpiece, and it may also make difficult the automatic control of workpiece dimensions through a screw-down system.

It is an object of the present invention to provide an improved mounting for a removable rolling mill work roll.

According to one aspect of the invention a rolling mill roll assembly comprises a roll shaft adapted to be driven at one end and having a free end face at the other end, a radially expandable locating spigot extending axially outward of said shaft, a roll having a cylindrical axial recess shaped to receive said spigot, and releaseable means for urging said roll axially against the free end face of the shaft to axially locate the roll relative to the shaft, the arrangement being such that when the roll is urged axially towards the free end face of the shaft, the spigot expands to positively engage the cylindrical surface of the roll recess so as to radially locate the roll to said shaft.

The spigot may be annular and have an inner surface which is inclined to the axis of the shaft. A coaxial member may be mounted within the spigot such that that when the roll is urged towards the shaft, the coaxial member presses upon the inner surface of the spigot thereby causing it to expand. The spigot may be split at one or more locations around its circumference.

A constant force transmitting device may be interposed between the roll and the coaxial member so that when the roll is being urged towards the shaft, a constant force is applied through the coaxial member to the spigot. The coaxial member and the spigot may be separated in an axial direction by a resilient member. This resilient member may also be a constant force transmitting device.

Figure 2:
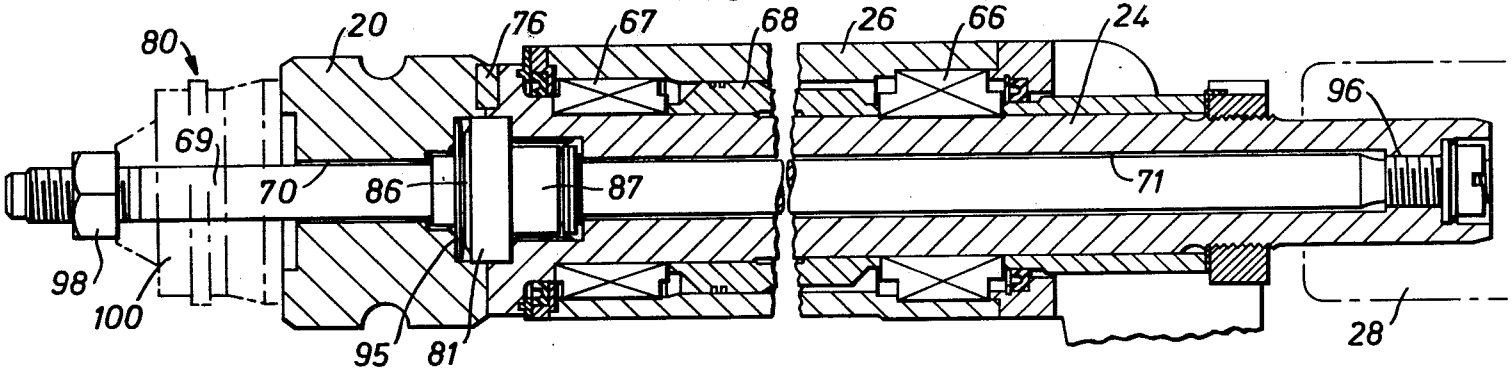
Figure 3:
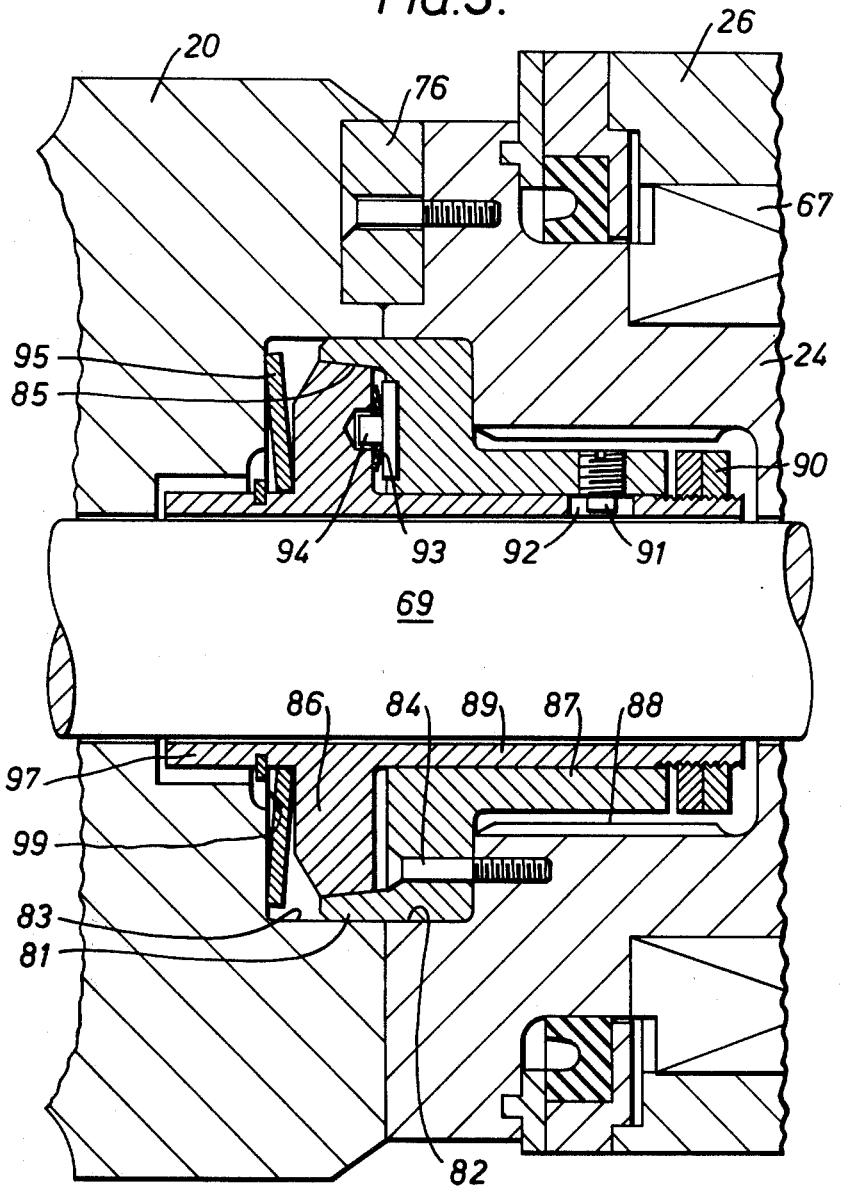

An embodiment of the invention will now be described, by way of example only, with reference to the accompanying drawings, in which:

FIG. 1 is a part sectional side elevation of a stand of a close coupled four high rolling mill for rolling metal bar, FIG. 2 is a longitudinal sectional view of the work roll arm and assembled work roll assembly of the stand of FIG. 1, and FIG. 3 is an enlarged fragmentary view of part of FIG. 2.

In FIG. 1, a rolling mill stand is shown having a frame including a pair of frame standards 13, 14 and upper and lower cross beams 15, 16. The standards are secured to the side frame webs 17, 18 which are in the shape of right angle isosceles triangles and each have a rearward flange 19 and a base flange 19a for securing to the basic frame of the mill.

The stand comprises a pair of work rolls 20, 21 backed up by respective support rolls 22, 23. The work rolls 20, 21 are releaseably secured to the free ends of drive shafts 24, 25 which are rotatably carried in respective work roll arms 26, 27 and driven through couplings 28, 29 by electric motors (not shown). The two arms 26, 27 are pivotally mounted one to the other by pivot pin 30.

The support rolls 22, 23 are rotatably mounted to and carried by upper and lower support roll arms 35, 36. Each arm comprises a central web 37 with upper and lower flanges 38, 39 secured to a massive forward chock 40. Each arm is mounted at its rearward end for pivotal movement about a respective pivot pin 41 by means of an eccentric pivot pin arrangement.

Further details of the general mill arrangement are disclosed in U.S. Pat. Nos. 3,861,190 and 3,818,742 and British Pat. No. 1,411,973.

Referring to FIG. 2, the (upper) work roll drive shaft 24 is rotatably mounted within its arm 26 by means of a rearward thrust and radial bearing arrangement 66 and a forward radial bearing arrangement 67. A sleeve 68 is engaged between the bearings to transmit axial thrust from the forward to the rearward bearing. A bolt 69 hydraulically loaded extends through an axial bore 70 in the work roll 20 and through an axial bore 71 in the drive shaft 24 to be threadedly received in a threaded bore 96 at the driven end of the drive shaft. The work roll 20 is releaseably secured to the free end of the work roll drive shaft 24 by means of a nut 98 and a hydraulic cylinder device 80 acting in cooperation with the bolt 69. Such a device is shown in detail in U.K. Specification No. 1,240,656. A key 76 in the form of a curved member concentric with the roll axis is engaged between the work roll 20 and the free end of drive shaft 24. The key 76 is secured to the shaft by flush screws and extends concentrically of the roll axis to somewhat less than 180° of the roll circumference and engages at its ends seating surfaces in both the shaft 24 and the roll 20, whereby to transmit rotational motion from the shaft 24 to the roll 20.

An annular locating spigot 81 extends axially outward from a first axial recess 82 in the free end of shaft 24. The work roll 20 has a cylindrical axial recess 83 on its face adjacent the free end of shaft 24. The recess 83 has an internal end face 99 in a radial plane of the roll. In its assembled position the roll 20 is engaged and located radially to the shaft 24 by the spigot 81 fitting tightly within the work roll recess 83.

Details of the spigot arrangement are seen more clearly in FIG. 3, which shows the roll 20 fully assembled to the shaft 24. The annular spigot 81 is secured to the drive shaft 24 by screws 84. The spigot 81 has an inner surface 85 which is inclined at a small angle to the axis of shaft 24. This surface 85 is broken by radial splits at a number of symmetrically spaced locations around the spigot 81. A cylindrical neck portion 87 of spigot 81 extends into a second axial recess 88 of shaft 24. This second axial recess 88 is deeper and of smaller diameter than first recess 82, and is stepped from said first recess 82.

A coaxial expander cone 86 is mounted within the spigot 81. The expander cone 86 has a cylindrical extension 89 which fits between the neck portion 87 of spigot 81 and the bolt 69 and is retained at its end to spigot 81 by means of a nut 90. This allows limited axial movement between spigot 81 and expander cone 86 but ensures that disc springs 93 are retained on guides 94 when the assembly is relaxed.

The cylindrical extension 89 of expander cone 86 has a keyway 92. A mating key 91 located in the cylindrical extension 87 of the spigot 81 prevents rotation between the expander cone 86 and the spigot 81. The outer circumference of the expander cone 86 is inclined to the axis of shaft 24 at substantially the same angle as that to which the inner surface 85 of spigot 81 is inclined when the spigot 81 has been expanded.

The expander cone 86 is separated in an axial direction from the spigot 81 by means of resilient disc springs 93 mounted on guides 94. The work roll 20 is separated from the expander cone 86 by a disc spring 95 which is mounted on a forward cylindrical extension 97. This disc spring 95 is substantially larger than the disc springs 93 which are between the spigot 81 and the expander cone 86.

To mount the work roll 20 to shaft 24, the work roll is fitted over bolt 69 with the nut 98 and hydraulic cylinder device 80 removed. The roll 20 is then pushed along bolt 69 and engaged with key 76 until the internal end face 99 of the recess 83 of roll 20 comes into contact with the disc spring 95. The hydraulic cylinder device 80 is now fitted over the bolt 69 to contact work roll 20 and the nut 98 is screwed up on bolt 69 to contact the hydraulic device 80. The hydraulic device 80 is then operated to urge the work roll 20 towards the free end face of the drive shaft 24. The disc spring 95 transmits an axial force from the work roll 20 to the expander cone 86 due to the increasing load exerted by the hydraulic cylinder device 80. As the load increases the distortion of disc spring 95 transmits an increasing proportion of the force in a direction perpendicular to the axis of the expander cone 86. The expander cone 86 is forced under limited load towards the shaft 24, and the outer circumference of the expander cone 86 presses against the inner surface 85 of spigot 81 and causes it to expand radially outwards. This gradual radial expansion of spigot 81 as the work roll 20 approaches the end face of shaft 24 ensures that the cylindrical work roll recess 83 is accurately located on the radially outer surface of spigot 81. When the work roll 20 is fast against the end face of shaft 24 there is positive engagement of the cylindrical work roll recess 83 with the radially outer surface of spigot 81. The hydraulic load on the work roll 20 is then maintained whilst nut 100 is tightened to hold the work roll in place, and the hydraulic pressure can then be released.

During the mounting of the work roll 20 on the shaft 24, the smaller disc springs 93 are compressed under the load. When it is required to demount the work roll 20 from the shaft 24, the hydraulic device is pressurised until the nut 100 can be untightened. The hydraulic pressure is then released and as the axial load on the work roll 20 decreases, the disc spring 95 resumes its relaxed position and the disc springs 93 push the expander cone 86 axially away from the spigot 81, thereby causing the external diameter of spigot 81 to shrink and be disengaged from the cylindrical work roll recess 83. Nut 98 is then removed from bolt 69 and the work roll 20 and the hydraulic cylinder device 80 can then be withdrawn from the shaft 24 and pulled along bolt 69 for changing.

We claim:

1. A roll assembly comprising a roll shaft adapted to be driven at one end and having a free end face at the other end, a radially expandable locating spigot fixedly secured to said roll shaft and extending axially outward of the free end face of said shaft, a roll at the free end of said shaft having a central bore extending therethrough and a cylindrical axial recess at one end of said bore surrounding said spigot for cooperation therewith, means responsive to movement of said roll toward the free end of said shaft for expanding said spigot, and releasable means for urging said roll axially against the free end face of the shaft to axially locate the roll relative to the shaft, the arrangement being such that when the roll is urged axially towards the free end face of the shaft, the spigot expands to positively engage the cylindrical surface of the roll recess so as to radially locate the roll to said shaft.

2. A roll assembly according to claim 1 in which the spigot is annular and has an inner surface which is inclined to the axis of the shaft.

3. A roll assembly according to claim 2 in which said means for expanding the spigot includes a coaxial member mounted within the spigot, said coaxial member being movable in an axial direction relative to said spigot such that when the roll is urged towards the shaft, the coaxial member presses upon the inner surface of the spigot thereby causing it to expand.

4. A roll assembly according to claim 1 in which the spigot is split at one or more locations around its circumference.

5. A roll assembly according to claim 3 in which a constant force transmitting device is interposed between the roll and the coaxial member so that when the roll is being urged towards the shaft a constant force is applied through the coaxial member to the spigot.

6. A roll assembly according to claim 3 in which the coaxial member and the spigot are separated in an axial direction by a resilient member.

7. A roll assembly according to claim 6 in which the resilient member which separates the coaxial member from the spigot is a constant force transmitting device.

8. A roll assembly according to claim 1 in which the releasable means comprises a bolt extending axially through both the shaft and the roll and protruding from said roll, the bolt being threaded at its end which protrudes from the roll, a nut adpated to engage the threaded portion of said bolt, and a hydraulic cylinder device positioned between the nut and the roll.

* * * * *